US006484786B1

(12) United States Patent
Ruggles et al.

(10) Patent No.: US 6,484,786 B1
(45) Date of Patent: Nov. 26, 2002

(54) LIGHT CONTROL WINDOW COVERING AND METHOD AND APPARATUS FOR ITS MANUFACTURE

(75) Inventors: Bryan K. Ruggles, Salt Lake City, UT (US); Maria R. Gil, East Greenwich, RI (US); George G. Gil, East Greenwich, RI (US); Warren Stephenson, West Greenwich, RI (US); Julian Rokicki, Warwick, RI (US)

(73) Assignee: Newell Window Furnishings, Inc., Freeport, IL (US)

( * ) Notice: Subject to any disclaimer, the term of this patent is extended or adjusted under 35 U.S.C. 154(b) by 0 days.

(21) Appl. No.: 09/549,969

(22) Filed: Apr. 14, 2000

(51) Int. Cl.[7] ..... E06B 9/06

(52) U.S. Cl. ..... 160/84.05; 160/121.1; 160/166.1 R

(58) Field of Search ..... 160/84.04, 84.05, 160/89, 84.01, 166.1 R, 168.1 R, 178.3 R, 121.1

(56) References Cited

U.S. PATENT DOCUMENTS

| | | | | |
|---|---|---|---|---|
| 2,865,446 | A | * | 12/1958 | Cole |
| 3,384,519 | A | | 5/1968 | Froget |
| 4,039,019 | A | | 8/1977 | Hopper |
| 4,386,454 | A | | 6/1983 | Hopper |
| 5,228,936 | A | | 7/1993 | Goodhue |
| 5,313,999 | A | | 5/1994 | Colson et al. |
| 4,194,550 | A | | 8/1994 | Hopper |
| 5,419,385 | A | * | 5/1995 | Vogel et al. |
| 5,664,613 | A | * | 9/1997 | Jelic |
| 5,845,690 | A | * | 12/1998 | Colson et al. |
| 5,846,360 | A | | 12/1998 | Gil |
| 5,885,409 | A | | 3/1999 | Gil |
| 5,888,639 | A | | 3/1999 | Green et al. |
| 5,891,208 | A | | 4/1999 | Gil |
| 6,112,797 | A | | 9/2000 | Colson et al. |
| 6,152,068 | A | | 11/2000 | Colson et al. |
| 6,196,291 | B1 | * | 3/2001 | Rupel et al. |
| 6,299,115 | B1 | * | 10/2001 | Kovach et al. |
| 6,302,982 | B1 | * | 10/2001 | Corey et al. |

FOREIGN PATENT DOCUMENTS

| | | | |
|---|---|---|---|
| FR | 1521488 | | 3/1968 |
| GB | 756270 | * | 9/1956 |

* cited by examiner

*Primary Examiner*—Blair M. Johnson

(57) ABSTRACT

A light-control window covering includes a first sheet of sheer material, and a second sheet of sheer material spaced apart from the first sheer sheet of material. A plurality of vanes having a first face and a second face, a center region and a first and a second longitudinal margin, the first face of each vane being ultrasonically welded to the first and second sheets of sheer material along the respective first and second longitudinal margins. The vanes are welded to the first and second sheer sheets of material, while the first and second sheer materials are spaced apart and parallel to one another. The welded first and second sheets of sheer material and vanes are then shifted from a light-passing position to a light-blocking position and heat set.

28 Claims, 13 Drawing Sheets

LIGHT CONTROL WINDOW COVERING AND METHOD AND APPARATUS FOR ITS MANUFACTURE

FIELD OF THE INVENTION

The present invention relates generally to the field of window coverings, and more particularly, to a light control window covering and a method and apparatus for its manufacture.

BACKGROUND OF THE INVENTION

Light control window coverings typically include a front and rear portion made from a sheer material and a plurality of opaque vanes extending between the sheer material. The light control covering is movable from an open, light-passing position in which the vanes are horizontal, to a light-blocking position in which the vanes are substantially vertical.

Numerous methods have been developed to form light control window coverings. U.S. Pat. No. 3,384,519 to Froget discloses a method of welding the marginal edges of a plurality of vanes to two layers of material. First, each vane is welded to one face of the first layer of material. As each vane is welded to the first layer of material, the first layer and the welded vane are wound onto a reel. After all of the vanes have been welded to the first layer of material and wound onto a reel, the combination is then unwound such that the free edge of each vane comes into contact with a second layer of material. The free edge is then welded to the second layer of material. In this manner a light-control window covering is formed with one face of the vane being welded at its marginal edge to the first layer and the second face of the vane being welded at its second marginal edge to the second layer.

U.S. Pat. No. 5,313,999 to Colson et al. describes a method and apparatus for forming a light-control window covering, in which one side of individual vanes are attached with adhesive to a first continuous sheet of material and the other side of the vanes are then attached with adhesive to a second continuous sheet of material. The first and second sides of each vane are attached to the first and second sheets in a continuous line. Both the Froget and Colson patents require that the vanes be attached to the first and second sheets individually, one at a time.

U.S. Pat. No. 5,228,936 to Goodhue, describes a method and apparatus for forming a light-control window covering, in which all of the vanes are attached with adhesive to the first and second sheets simultaneously. As in Froget and Colson, one side of each vane is attached to a first sheet and the other side of each vane is attached to a second sheet. Since the vanes are applied to the first and second sheets side by side, the vanes do not overlap when the window covering is in the light-blocking position. As a result, light is likely to pass through the spaces between adjacent vanes.

U.S. Pat. No. 5,888,639 to Green et al. discloses a method and apparatus for forming a light-control window covering formed by continuously welding three substrates of material together to form a three-substrate web having first and second light-control regions and a center vane or opaque region located therebetween. Portions of the three-substrate web are laterally offset from one another and adhesively attached to from a light-control window covering.

U.S. Pat. Nos. 5,846,360; 5,885,409; and 5,891,208, to Gill, an inventor common to the instant application, disclose a method and apparatus for manufacturing a multilayer filter by attaching first and second filter layers to a plurality of ribbons utilizing ultrasonic welding equipment.

It would be desirable to form a light-control window covering in which all of the vanes are simultaneously attached to the first and second sheets where the vanes of the resultant light-control window covering overlap one another in the open or light-passing position.

SUMMARY OF THE INVENTION

One embodiment of this invention relates to a light-control window covering comprising a first sheet of sheer material, and a second sheet of sheer material spaced apart from the first sheet of sheer material. A plurality of vanes is ultrasonically welded to the first and second sheets of sheer material. Each vane includes a first face and a second face, a center region, and a first and a second longitudinal margin. The first face of each vane is ultrasonically welded to the first and second sheets of sheer material along the respective first and second longitudinal margins.

The vanes are movable from a light-passing position in which the center region of each vane is substantially perpendicular to the first and second sheets of sheer material, to a light-blocking position in which the center region of each vane is substantially parallel to the first and second sheets of -sheer material. The second longitudinal margin of each vane is folded over and adjacent the center region of each respective vane in the light-blocking position. The vanes are spaced from one another such that in the light-blocking position the first longitudinal margin of one vane overlaps the second longitudinal margin of an adjacent vane.

Another embodiment of this invention includes a method for manufacturing the light-control window covering comprising feeding along a path a first and a second sheet of sheer material spaced apart from and parallel to one another. Each sheet of sheer material has a longitudinal direction and a cross-wise direction perpendicular to the longitudinal direction. The method further includes feeding a plurality of strips of vane material. Each strip of vane material has a pair of longitudinal edges and a predetermined width as measured between the longitudinal edges, a center region, a first side and a second side, and first and second longitudinal margins. Each strip of vane material is separated from an adjacent strip of vane material by a predetermined distance that is less than the predetermined width of the strip of vane material. The strips of vane material are bonded to the first sheet of sheer material along the first longitudinal margin and to the second sheet of sheer material along the second longitudinal margin.

Still another embodiment includes an apparatus for manufacturing a light-control window covering having a first sheet of sheer material, a second sheet of sheer material and a plurality of vanes. The apparatus includes a plurality of folders spaced apart from one another for folding the longitudinal margins of the vanes. Additionally, the apparatus includes a plurality of first ultrasonic welders for welding a first longitudinal margin of each vane to the first sheet of sheer material, and a plurality of second ultrasonic welders for welding a second longitudinal margin of each vane to the second sheet of sheer material. A plurality of rotary anvils are located between the first and second sheets of sheer material for attaching each respective vane to the second sheet of sheer material. A shifter moves the first and second sheets of sheer material relative to one another such that the center region of the vanes are substantially parallel to the first and second sheets of sheer material. Finally, a presser presses the first sheet of sheer material, the second sheet of sheer material, and the plurality of vanes.

These and other benefits and features of the present invention will be apparent upon consideration of the following detailed description of preferred embodiments thereof, presented in connection with the following drawings in which like reference numerals identify like elements throughout.

DETAILED DESCRIPTION OF THE PREFERRED EMBODIMENTS

Figure 1:
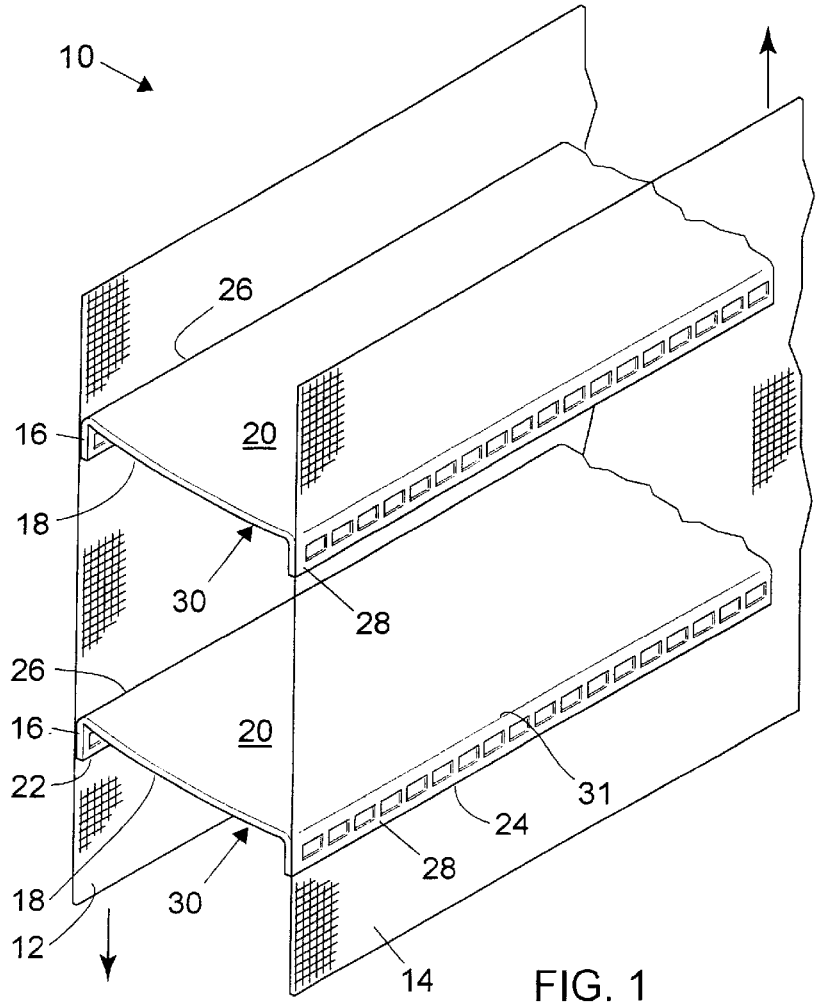
FIG. 1 is a perspective view of a light-control window covering.

Referring to FIG. 1, a light-control window covering 10 includes a first sheet of sheer material 12 and a second sheet of sheer material 14. The first and second sheets of sheer material are disposed substantially parallel to one another.

A plurality of vanes 16 having a first side 18 and a second side 20 are ultrasonically welded to the first and second sheets of material 12, 14. Each vane 16 includes first and second longitudinal edges 22, 24, and a corresponding first and second margin 26, 28. Each vane 16 is formed in a "U" shape with the longitudinal margins 26, 28 of the second side ultrasonically welded to the respective first and second sheets of sheer material 12, 14. In this manner the second side 20 of each vane 16 is adjacent the first and second sheets of sheer material 12, 14 along the respective longitudinal margins 26, 28. The longitudinal margins 26, 28 on the first side of each vane 16 faces away from the first and second sheets of sheer material 12, 14 respectively. Each vane 16 is preferably formed of an opaque material.

The term "sheer material" as used herein includes woven, non-woven, natural and synthetic materials with the ability to pass at least a portion of light therethrough. In the preferred embodiment, the first sheet of material is a knit sheer having a diamond shape interstices. The first sheet could be formed from either a single or multi-filament yarn. The multi-filament yarn allows for greater movement of the material during the pressing operation as is described below. This helps to minimize puckering or wrinkles in the final light-control window covering. The second sheet of material is also a knit sheer, preferably having a different shaped interstice than the first sheet in order to minimize the moire appearance. The vane material is preferably an opaque knit, having a similar elongation to. the first and second sheer sheets in order to minimize any wrinkles forming in the product. However, the vane material could also be a woven or non-woven polyester, as well as a film. If the sheets of sheer material and the vanes are attached utilizing adhesive or by sewing with thread, other materials may be used as well including natural materials.

In the preferred embodiment all three materials are made from polyester or other compatible material or film that can be welded. However, other types of material could be used such as fabric where an adhesive or thread is used to attach the vane material to the first and second sheets of sheer material. It is also desirable that the opaque vanes have a relative elongation characteristic equal to or greater than the first and second sheer sheets.

Figure 2A:
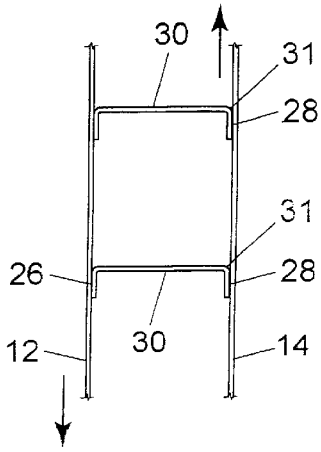
FIG. 2A is a cross-sectional view of the light-control window covering of FIG. 1 in the light-passing position taken along lines 2A—2A of FIG. 1.
Figure 2B:
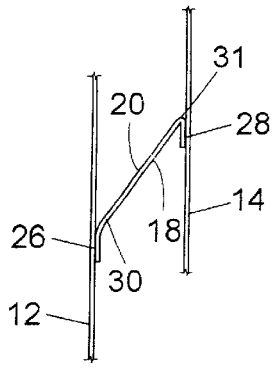
FIG. 2B is a cross-sectional view of the light-control window covering of FIG. 2A in the light-blocking position.
Figure 2C:
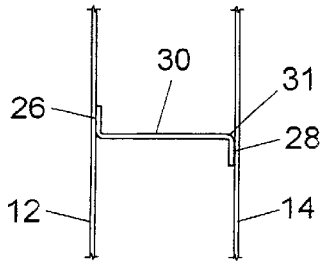
FIG. 2C is a cross-sectional view of a portion of a light-control window covering with s-shaped vanes.

In a horizontal embodiment, the vanes 16 are substantially horizontal in a first light-passing position. (See FIG. 2A). In the preferred embodiment the light-control window covering is placed in a window such that the first sheet of sheer material 12 faces inward and the second sheet of sheer material 14 is close to or facing the window. The longitudinal margins 26, 28 are welded to the first and second sheets of sheer materials 12, 14 on the second side 20 of the vane material. As a result, each vane 16 is U-shaped. In the light-passing position, the center regions 30 of the vanes 16 are horizontal and parallel to one another. The light-control window covering 10 can be moved to a light-blocking position by shifting the first and second sheets of sheer material 12 and 14 relative to one another. (See FIG. 2B). In the preferred embodiment the second sheet of sheer material 14 is shifted upward relative to the first sheet of sheer material 12. As a result, the center region 30 of each vane 16 is shifted to a substantially vertical position, thereby blocking light from passing through the window covering 10. In the light-blocking position the first longitudinal margin 26 is substantially coplanar with the center region 30 of each vane, while the second longitudinal margin 28 is bent at a crease 31 approximately one hundred and eighty degrees relative to the plane of the center region 30. In the preferred embodiment, when the light-control window covering 10 is in the light-blocking position, the first longitudinal margin 26 of one vane 16 overlaps the longitudinal margin 28 of an adjacent vane 16.

Figure 3:
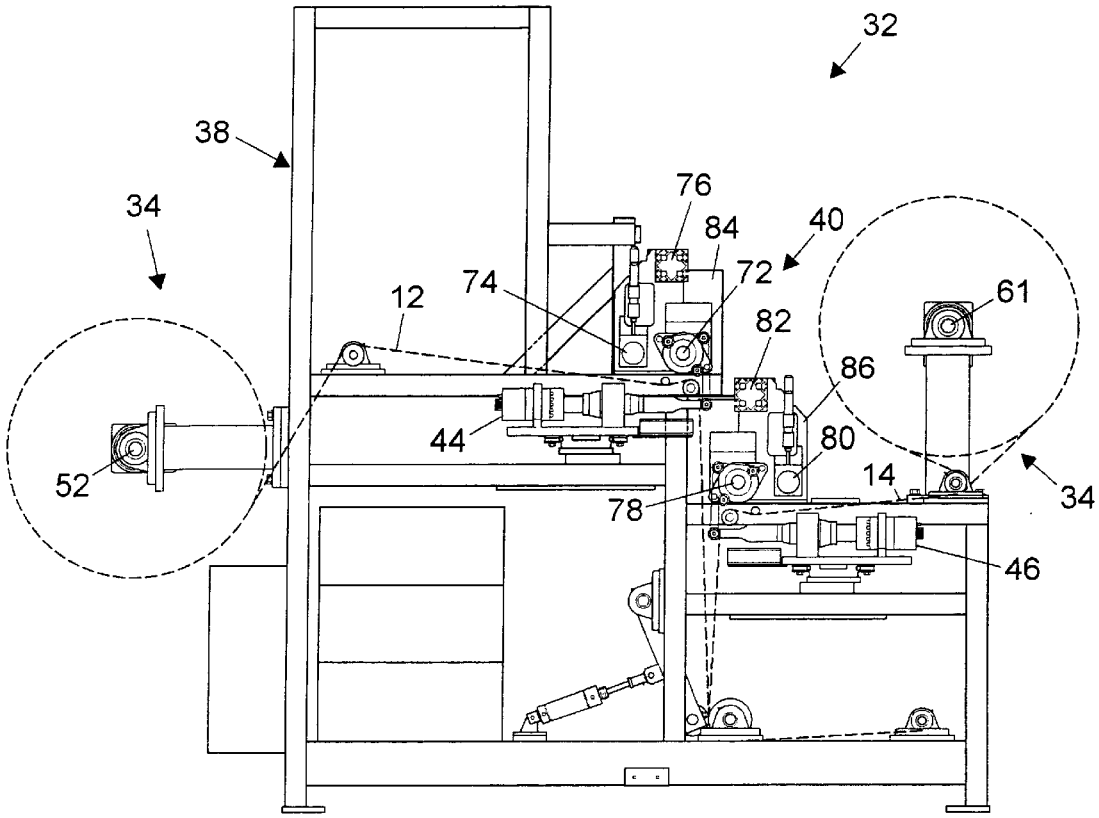
FIG. 3 is a plan view of the apparatus with the frame for manufacturing a light-control window covering of FIG. 1.
Figure 4:
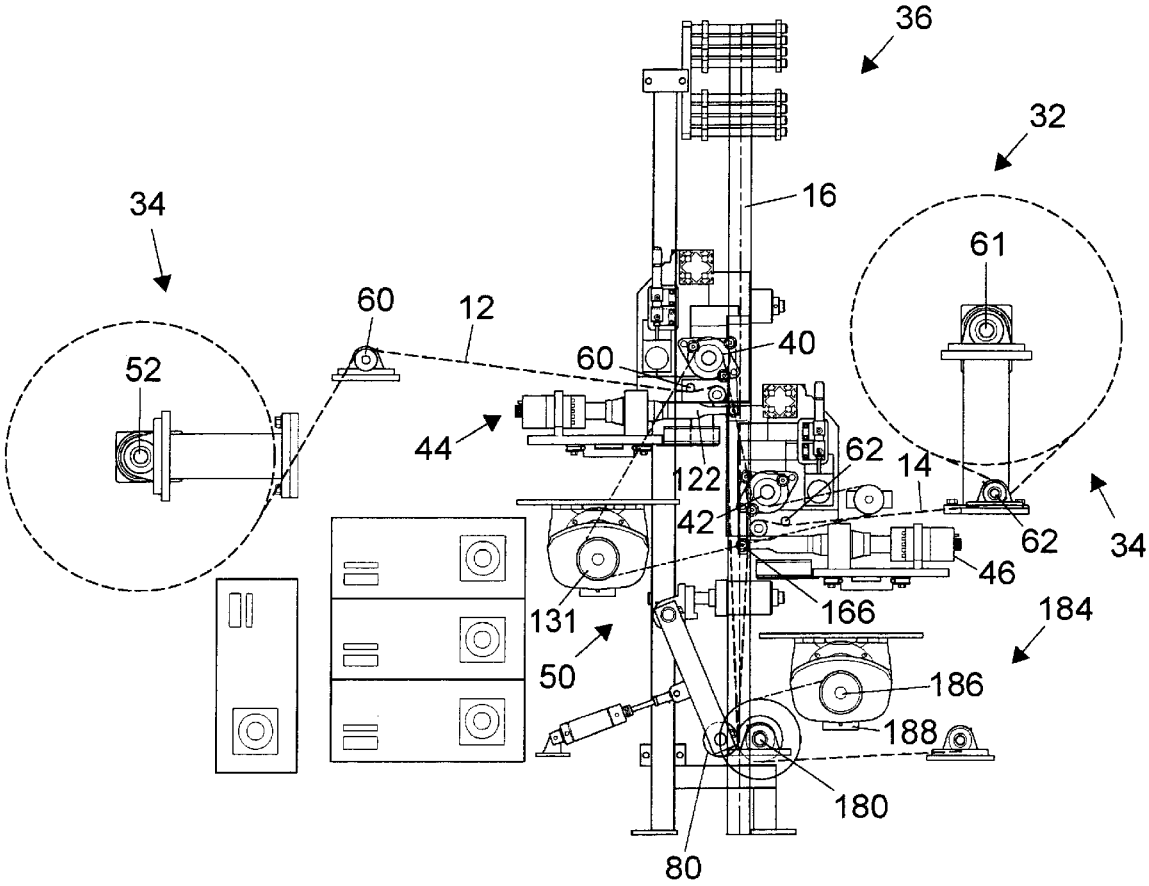
FIG. 4 is a plan view of the apparatus with the vane feeding assembly frame for manufacturing a light-control window covering of FIG. 1.

An apparatus 32 is illustrated in FIGS. 3 and 4 for manufacturing the light-control window covering 10. The apparatus 32 includes a first and second sheer sheet material feeding assembly 34 and a vane or ribbon feeding assembly 36 for simultaneously feeding a plurality of vane materials 16 to the apparatus 32 for simultaneous processing. A frame 38 supports an plurality of upper and lower folding assemblies 40, 42 for positioning respective pieces of vane material 16 in a "U" shape before being welded to the first and second sheets of sheer material 12, 14 with an ultrasonic welder. The apparatus 32 includes a first and second or upper and lower welding station 44, 46 for each respective vane. As will be described below, a first shifter assembly 47 shifts the welded structure from an open three dimensional position to a closed two dimensional position for setting in the heat setting assembly 48. The heat setting assembly 48 removes any undesirable creases that may form in the vane 16 and first and second sheets of sheer materials 12, 14, during the manufacturing process. Finally a drive system 50 guides the sheet materials and vane material from the feeding assemblies 34, 36 through the upper and lower folding assembly 40, 42, through the welding stations 44, 46, through the heat setting assembly 48, and finally to a take up reel (not shown) for storage and subsequent fabrication.

The sheet material feeding assembly 34 includes a first spindle 52 attached to the frame 38 for rotatably supporting a reel of first sheet material 12. The width of the first sheet of sheer material 12 as it is being fed from the spool will be referred to as the cross direction, while the length of the first sheet of sheer material 12 as it is being fed from the spools will be referred to as the longitudinal direction. The cross direction of the first sheet of sheer material 12 represents the length of the horizontal light-control window covering, and the longitudinal direction represents the width of the horizontal light-control window covering.

The first sheet of sheer material 12 is thread over rollers 60 and presented to the first welding station 44 in a vertical position such that the front face of the first sheet of sheer material 12 is facing the welding station 44. Similarly, a second spindle 61 attached to the frame 38 supports a reel of second sheet of sheer material 14. The second sheet of sheer material 14 is threaded over rollers 62 and presented in a vertical position such that its front face is facing the second welding station 46.

Figure 5:
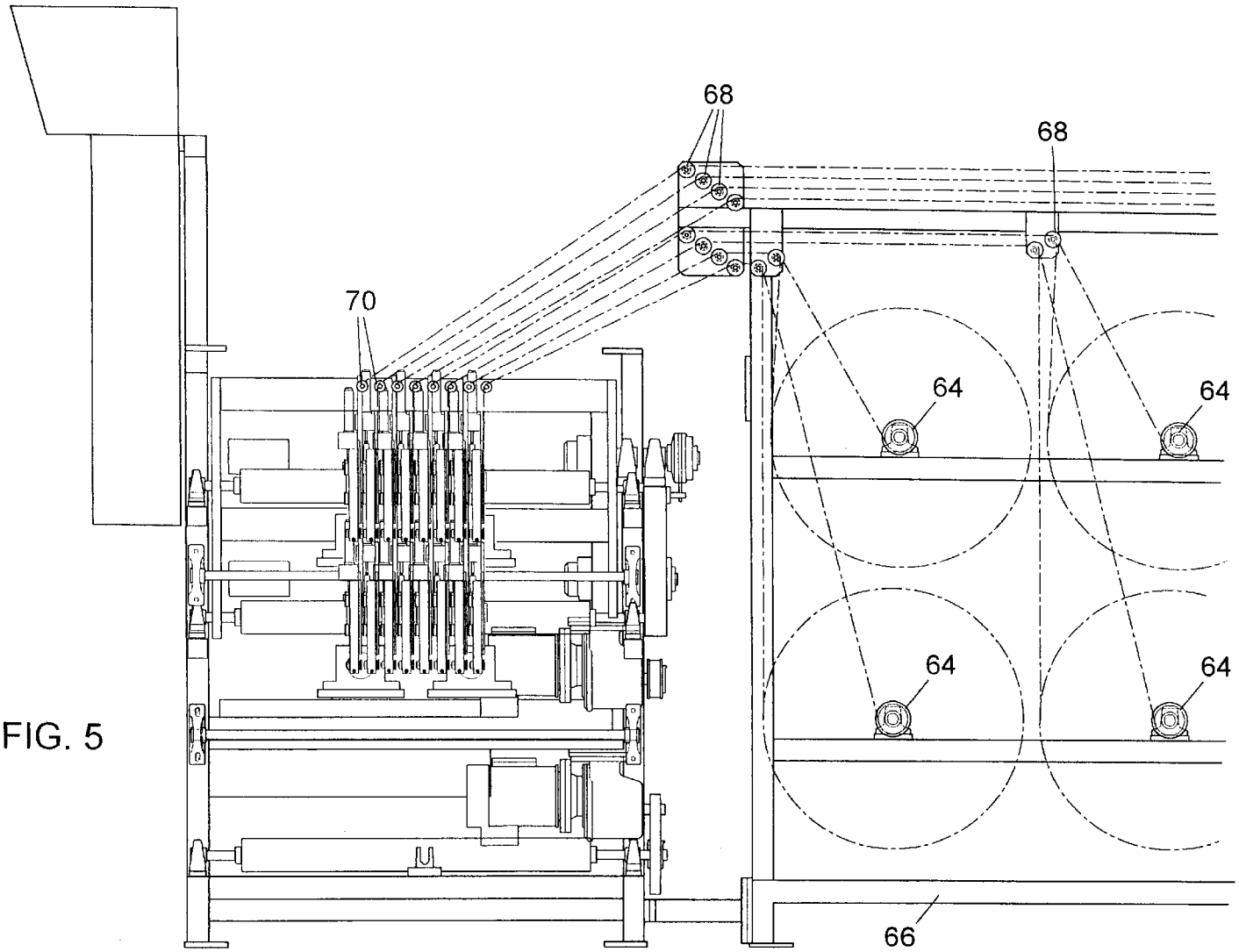
FIG. 5 is a plan view of the vane material feeding apparatus.

As illustrated in FIG. 5, the vane material feeding assembly 36 includes a plurality of spindles 64 secured to a support 66. Spools 67 of vane material 16 are rotatably supported on respective spindles 64. The vanes 16 of the window covering 10 are designated with the same reference numeral as the vane material 16, since the vanes 16 are formed from the vane material 16. Each piece of vane material 16 is threaded over rollers 68 that are attached to the support 66 and threaded over a vane guide roller 70 attached to the frame. Each guide roller 70 aligns respective vane material 16 with a respective upper folder assembly 40.

As a result, each piece of vane material 16 is presented to a respective upper folder assembly 40 in a vertical position, such that all of the pieces of vane material 16 are parallel to one another. The space between each piece of vane material 16 as it is presented to the upper folding assembly 40 determines the spacing of the vanes 16 in the final light-control window covering 10. The vane material 16 is fed into apparatus 32 such that the second side 20 of the vane material is perpendicular to the second face of the first sheet of sheer material 12. In the preferred embodiment the width of the vane material 16 is 2.062 inches.

Referring to FIGS. 6–9 the frame 38 includes an upper folder assembly shaft 72 and upper first and second cross-members 74, 76 extending the width of the frame 38 to support the first folding assemblies 40. Similarly, the frame 38 includes a lower folder assembly shaft 78 and lower first and second cross-members 80, 82 extending the width of the frame 38 to support the lower folding assemblies 42.

A plurality of upper brackets 84 secure the upper folder assembly shaft 72,.and upper first and second cross-members 74, 76 to one another at various points along their length to ensure greater stability of the first folding assemblies 40. Similarly, a plurality of lower brackets 86 secure the lower folder assembly shaft 78, and lower first and second cross-members 80, 82 to one another at various points to ensure greater stability of the second folding assemblies 42.

Figure 6:
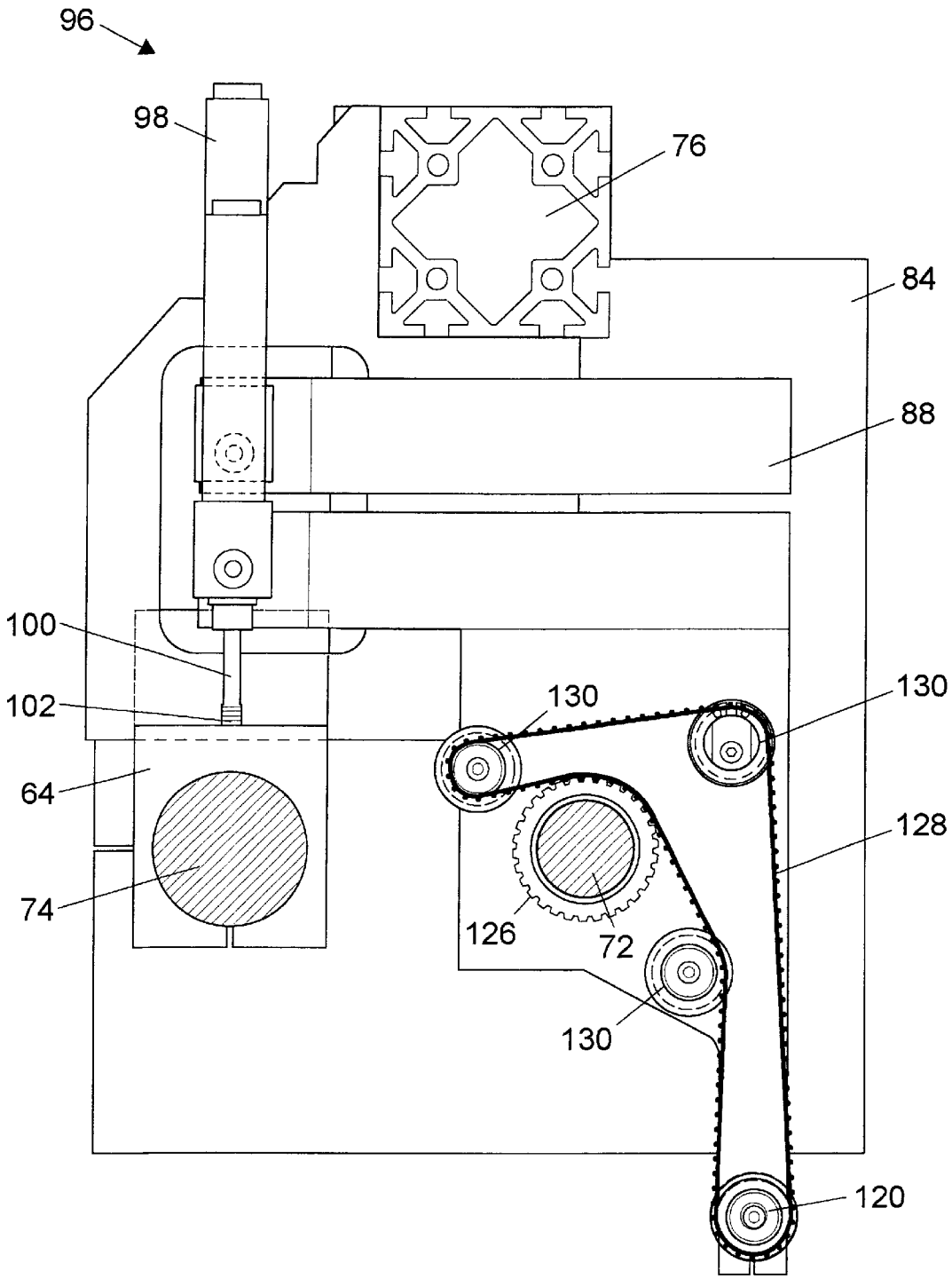
FIG. 6 is a plan view of the upper folding assembly.
Figure 7:
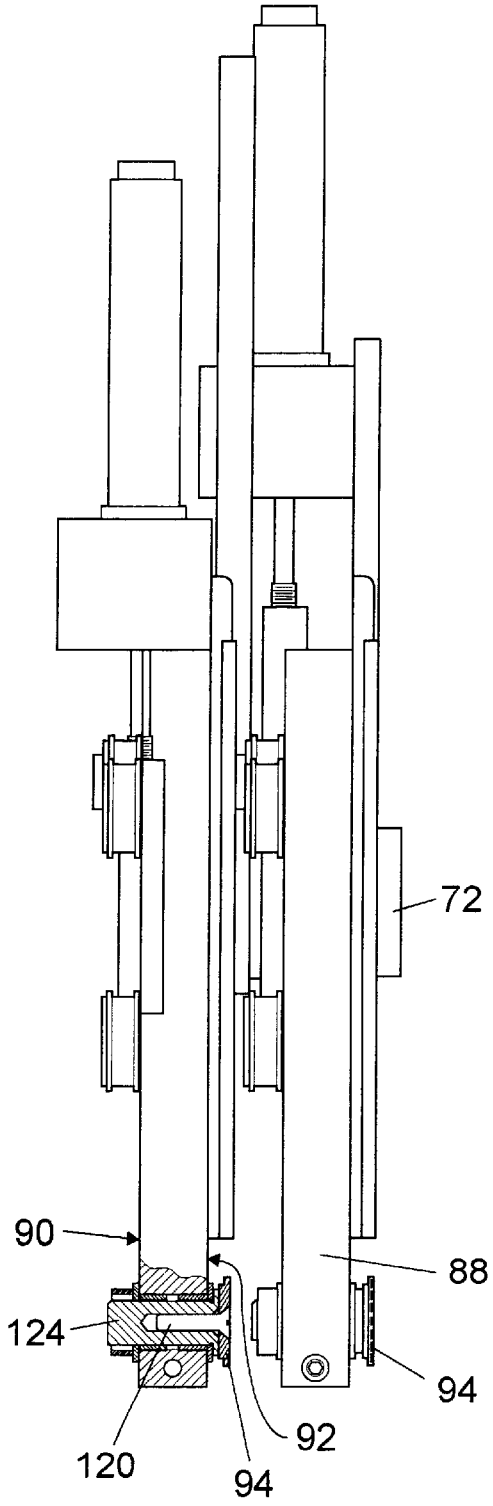
FIG. 7 is a side view of the upper folding assembly of FIG. 6.

Referring to FIGS. 6 and 7, the upper folder assembly 40 includes an upper folder assembly bracket 88 having a first side 90 and second side 92. The upper folder assembly bracket 88 is rotatably mounted on the upper folder assembly shaft 72 to position an upper anvil 94 proximate the upper welder 44. An arm 96 including a cylinder 98 and extension 100 is attached to the first side 90 of the upper bracket 88. In the exemplary embodiment the cylinder 98 is pneumatic, however, a hydraulic cylinder or any other mechanical control mechanism to extend an extension member could be employed. The extension 100 travels in or out of the cylinder 98 based on pressure provided in the cylinder. The free end 102 of the extension 100 is attached to the upper first cross member 74 with an arm support 104. Movement of the extension 100 in or out of the cylinder 98 causes the bracket 88 to rotate in a first and second direction respectively about the upper folder assembly shaft 72.

Figure 10:
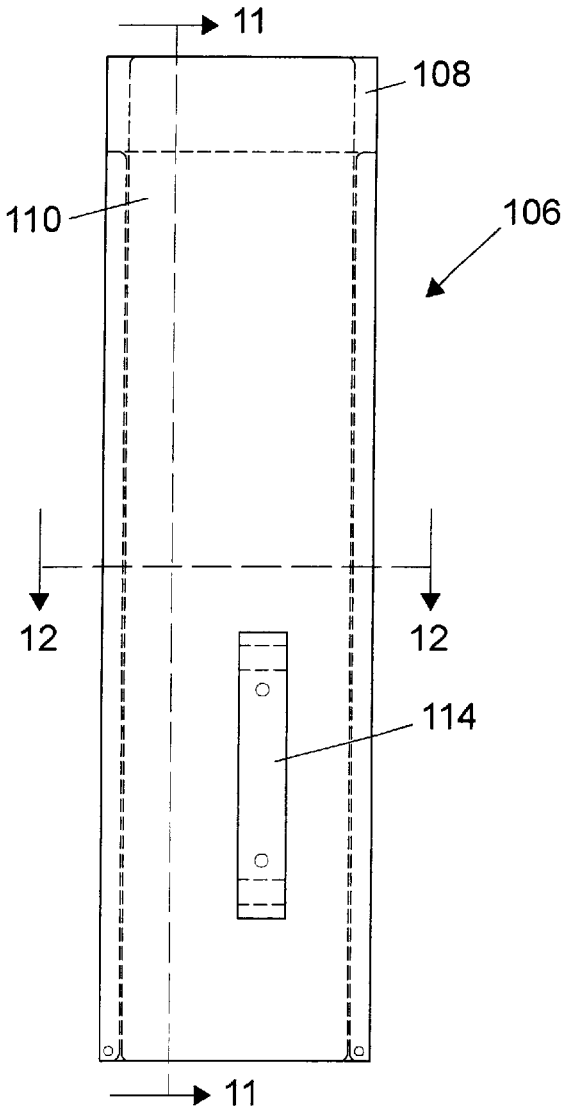
FIG. 10 is a plane view of the upper folder.
Figure 11:
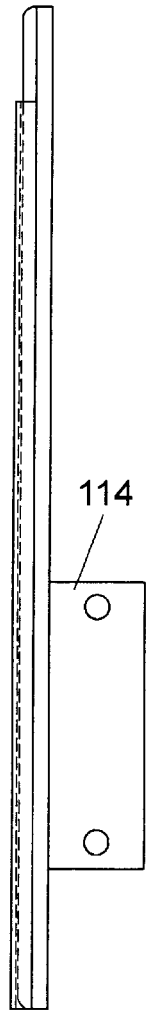
FIG. 11 is a cross-sectional view of the upper folder taken along lines 11—11 of FIG. 10.
Figure 12:
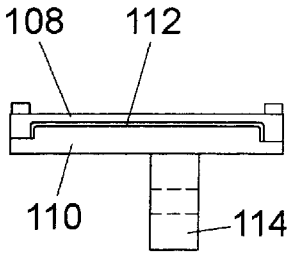
FIG. 12 is a cross-sectional view of the upper folder taken along lines 12—12 of FIG. 10.

Referring to FIGS. 10–12, the first or upper folder assembly 40 includes an upper folder or chute 106 having an exterior plate 108 and an interior plate 110 positioned within the exterior plate 108. The combined exterior plate 108 and interior plate 110 form a U-shaped channel 112 which bends the vane material 16 into a "U" shape The exterior and interior plates 108, 110 are secured together with a plurality of screws to facilitate cleaning the U-shaped channel by permitting separation of the plates. The interior plate 108 is attached to a mounting bracket 114 with fasteners for attachment to the second side 92 of the upper folder assembly bracket 88.

The width of the flat portion of the U-shaped channel 112 is less than the width of the vane material 16. Thus, the vane material 16 must bend to fit through the U-shaped channel 112. The vane material 16 is placed in the upper folder 106 so that the longitudinal margins 26, 28 are bent as the vane material 16 exits the bottom of the upper folder 106. When the vane material 16 exits the upper folder 106 the first longitudinal margin 26 is adjacent the first sheet of sheer material 12.

The upper anvil 94 is rotatably attached to the second side 92 of the upper folder assembly bracket 88 with a pin 120. The upper anvil 94 is located close to the bottom of the upper folder 106. The upper anvil 94 is located on the upper folder assembly bracket 88 such that movement of extension 100 out of the cylinder 98. This movement will cause the upper anvil 94 to move towards the welder 44, pressing the first longitudinal margin 26 of the vane material 16 and the first sheet of material 12 against a horn 122 of the first welder 44. Conversely, movement of the extension 100 into the cylinder 98 will cause the upper anvil 94 to move away from the horn 122 of the first welder 44.

The upper anvil 94 is driven by an anvil drive gear 124 located on the first side 90 of the upper folder assembly bracket 88 and is rotatably connected to the anvil 94 by means of the pin 120. The anvil drive gear 124 is in turn driven by anvil drive pulley 126 that rotates the upper folder assembly shaft 72. A belt 128 connects the anvil drive pulley 126 with the anvil drive gear 124 to rotate the anvil 94. The belt 128 is supported by a number of idler guide rollers 130. An end drive gear that is driven by a motor 131 rotates the upper folder assembly shaft 72. In this manner each anvil 94 is rotated at the same rate to ensure uniform welding of the vane material 16 to the first sheet of sheer material 12.

The lower folder assembly 42 includes similar components but uses a different folder as will be described below. Each of the components in the lower folder assembly 42, although similar to the components in the upper folder assembly 40 will be identified with a separate reference numeral for clarity.

Figure 8:
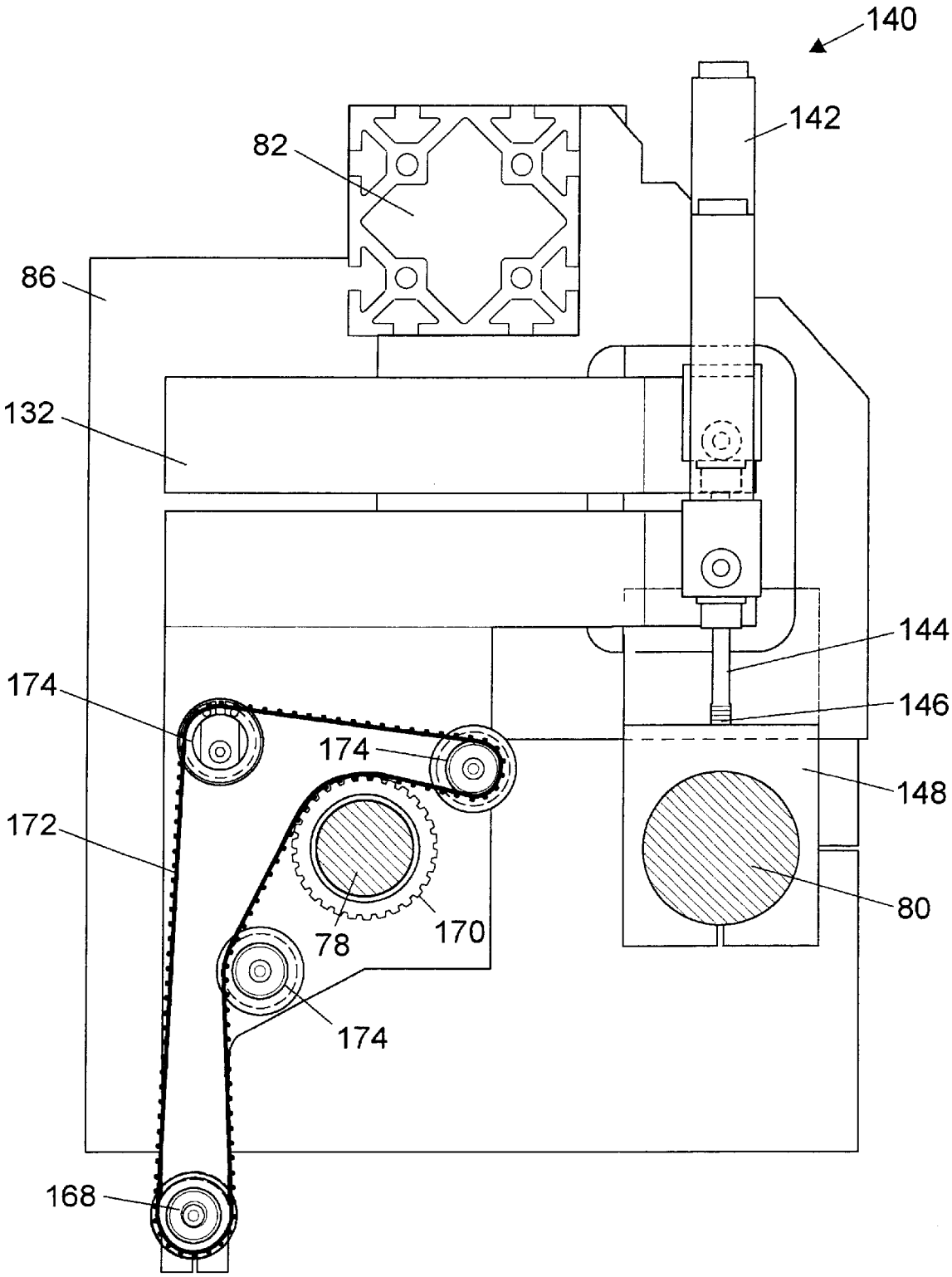
FIG. 8 is a plan view of the lower folding assembly.
Figure 9:
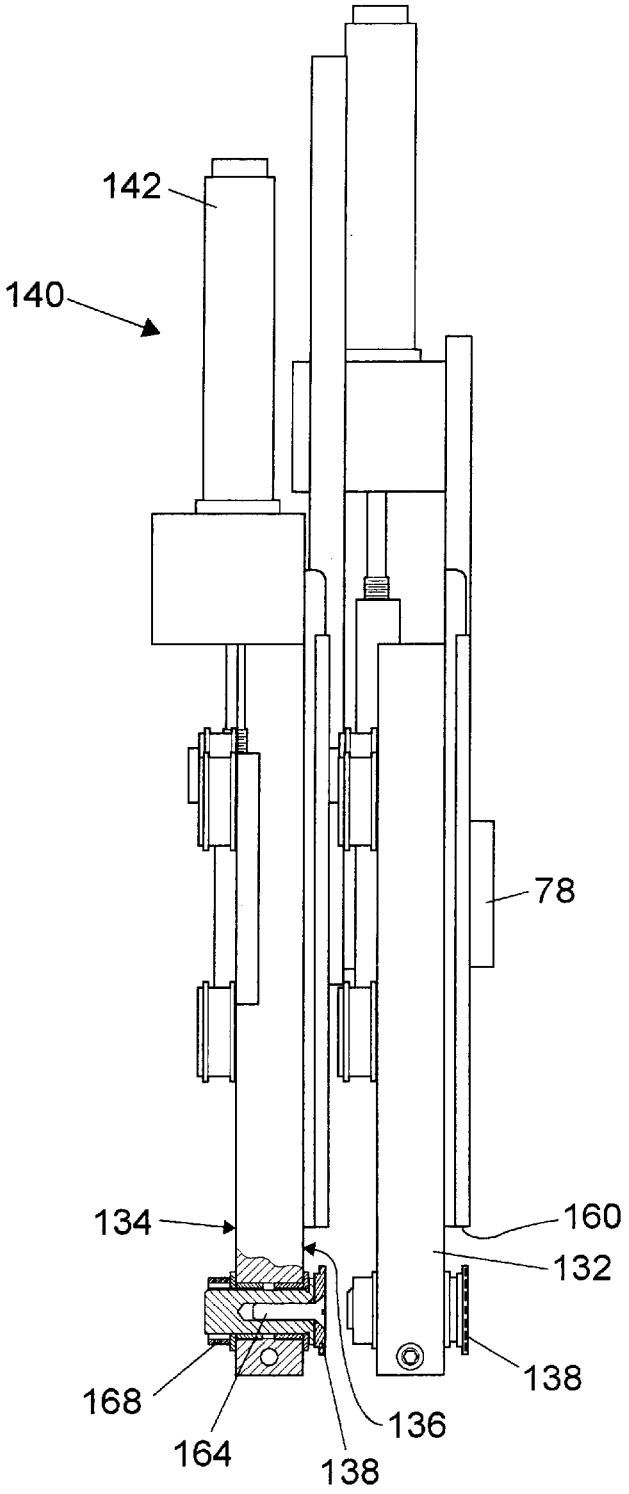
FIG. 9 is a side view of the lower folding assembly of FIG. 6.

Referring to FIGS. 8 and 9 the lower folder assembly 42 includes a lower folder assembly bracket 132 having a first and second side 134, 136. The lower folder assembly bracket 132 is rotatably mounted on the lower folder assembly shaft 78 to position a lower anvil 138 proximate the lower welder 46. An arm 140 including a cylinder 142 and extension 144 is attached to the first side 134 of the bracket 132. As discussed above, in the exemplary embodiment the cylinder 142 is pneumatic, however, a hydraulic cylinder or any other mechanical control mechanism to extend an extension member could be employed. The extension 144 travels in or out of the cylinder 142 based on pressure provided in the cylinder. The free end 146 of the extension is attached to the lower first cross member 80 with an arm support 148. Movement of the extension 144 in or out of the cylinder 142 causes the bracket 132 to rotate in a first and second direction respectively about the lower folder assembly shaft 78.

Figure 14:
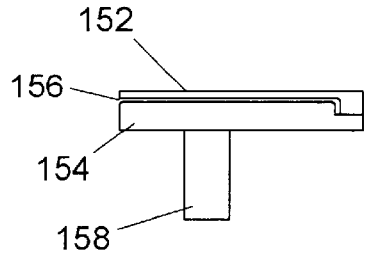
FIG. 14 is a cross-sectional view of the lower folder taken along lines 11—11 of FIG. 10.
Figure 13:
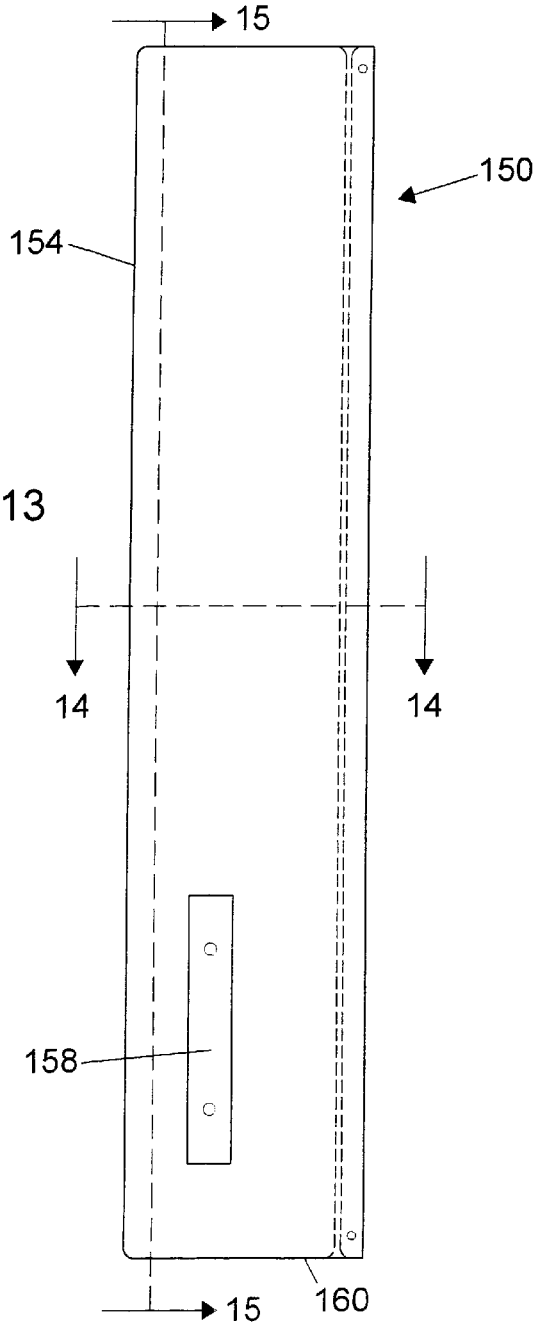
FIG. 13 is a plane view of the lower folder.
Figure 15:
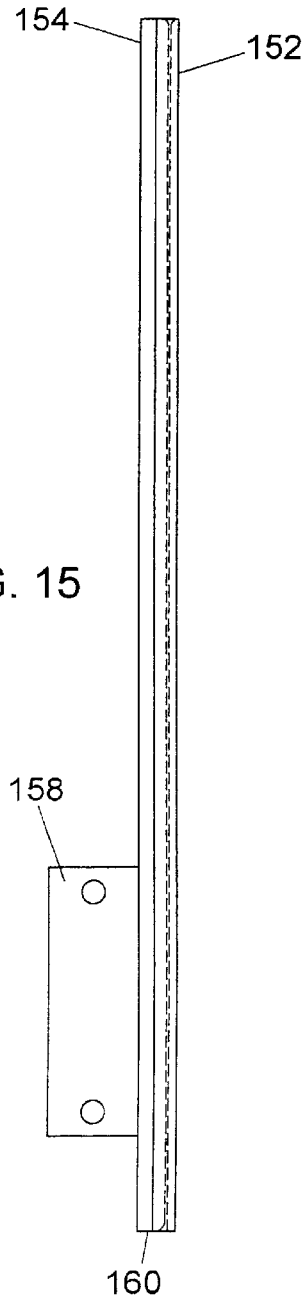
FIG. 15 is a cross-sectional view of the lower folder taken along lines 12—12 of FIG. 10.

Once the vane material 16 is welded to the first sheet of sheer material 12, the vane material 16,and first sheet of sheer material 12 are guided to the lower folder assembly 42. Since the vane material 16 is welded to the first sheet of sheer material 12, the lower folder assembly 42 must accommodate the first sheet of sheer material 12. Accordingly, as illustrated in FIGS. 13–15 a lower folder or chute 150 includes an external and an internal plate 152, 154 to form an L-shaped or right-angled channel 156 which bends the second longitudinal margin 28 of the vane material 16 into the U-shaped vane material 16 as described above.

The exterior and interior plates 152, 154 are secured together with a plurality of screws to permit easy access to the L-shaped channel for cleaning. The internal plate 154 is attached to a mounting bracket 158 with fasteners for attachment to the second side 136 of the lower folder assembly bracket 132.

The width of the L-shaped channel 156 is less than the width of the vane material 16. Thus, the vane material 16 must bend to fit through the L-shaped channel 156. The vane material 16 is threaded through the lower folder 150 so that the second longitudinal margin 28 is bent as the vane material 16 exits the bottom 160 of the lower folder 150. When the vane material 16 exits the lower folder 150 the second longitudinal margin 28 of the vane material 16 is adjacent the second sheet of sheer material 14.

The lower anvil 138 is rotatably attached to the second side 136 of the folder assembly bracket 132 with a pin 164. The anvil 138 is located close to the bottom portion 160 of the lower folder 150. The lower anvil 138 is located on the lower bracket 132 such that movement of the extension 144 out of the cylinder 142 will cause the lower anvil 138 to move towards the lower welder 46. As a result the second longitudinal margin 28 and the second sheet of sheer material 14 are pressed against a horn 166 of the lower welder 46. Conversely, movement of the extension 144 into the cylinder 142 will cause the lower anvil 138 to move away from the horn 166 of the lower welder 46.

The lower anvil 138 is driven by an anvil drive gear 168 located on the first side 134 of the folder assembly bracket 132 and is rotatably connected to the lower anvil 138 by means of the pin 164. The anvil drive gear 168 is in turn driven by anvil drive pulley 170 that rotates with the lower folder assembly shaft 78. A belt 172 connects the anvil drive pulley 170 with the anvil drive gear 168 to rotate the anvil 138. The belt 172 is supported by a number of idler guide rollers 174. As discussed above, the lower folder assembly shaft 78 is driven by the same motor 131 that drives the upper folder assembly shaft 72 to maintain uniform welding of the vane material 16 to both the first and second sheets of sheer material 12, 14.

Each horn 122, 166 of welders 44, 46 has a width which can be up to 10 inches and may be moved in a path parallel to the longitudinal axis of the upper and lower folder assembly shafts 72, 78. The vane material 16 is only welded to the first and second sheets of sheer material where the upper and lower anvils 94, 138 press the materials against the horns 166. The horns 122, 166 wear over time in the region that the anvils 94, 138 are pressing. By moving the horns 122, 166 along the path, the life of the horns can be extended. Depending on the spacing of the vane material, each horn can handle a number of anvils. Accordingly, the horn can be shifted upto the spacing of the anvils to extend the life of the horn surface.

Once, the longitudinal margins 26, 28 of the vane material 16 have been welded to the first and second sheet of sheer materials 12, 14, a continuous welded structure is formed. A pair of nip rollers 180 pulls the welded structure through the apparatus. The vane material 16 is welded to the first and second sheets of sheer material 12, 14 in an open or three dimensional position, such that the center region 30 of the vane material 16 is perpendicular to the first and second sheets of sheer materials 12, 14. The welded structure is then closed such that the center region 30 of the vane material 16 is substantially parallel to the first and second sheets of sheer material 12, 14. This requires shifting the sheets of sheer material 12, 14 in the cross machine or horizontal direction as the first and second sheet material 12, 14 and welded vane material 16 exit the second welder 46. If the welded sheets are not shifted, a crease will be formed in the middle of the vane material 16 as it travels through the nip rollers 180.

Figure 16:
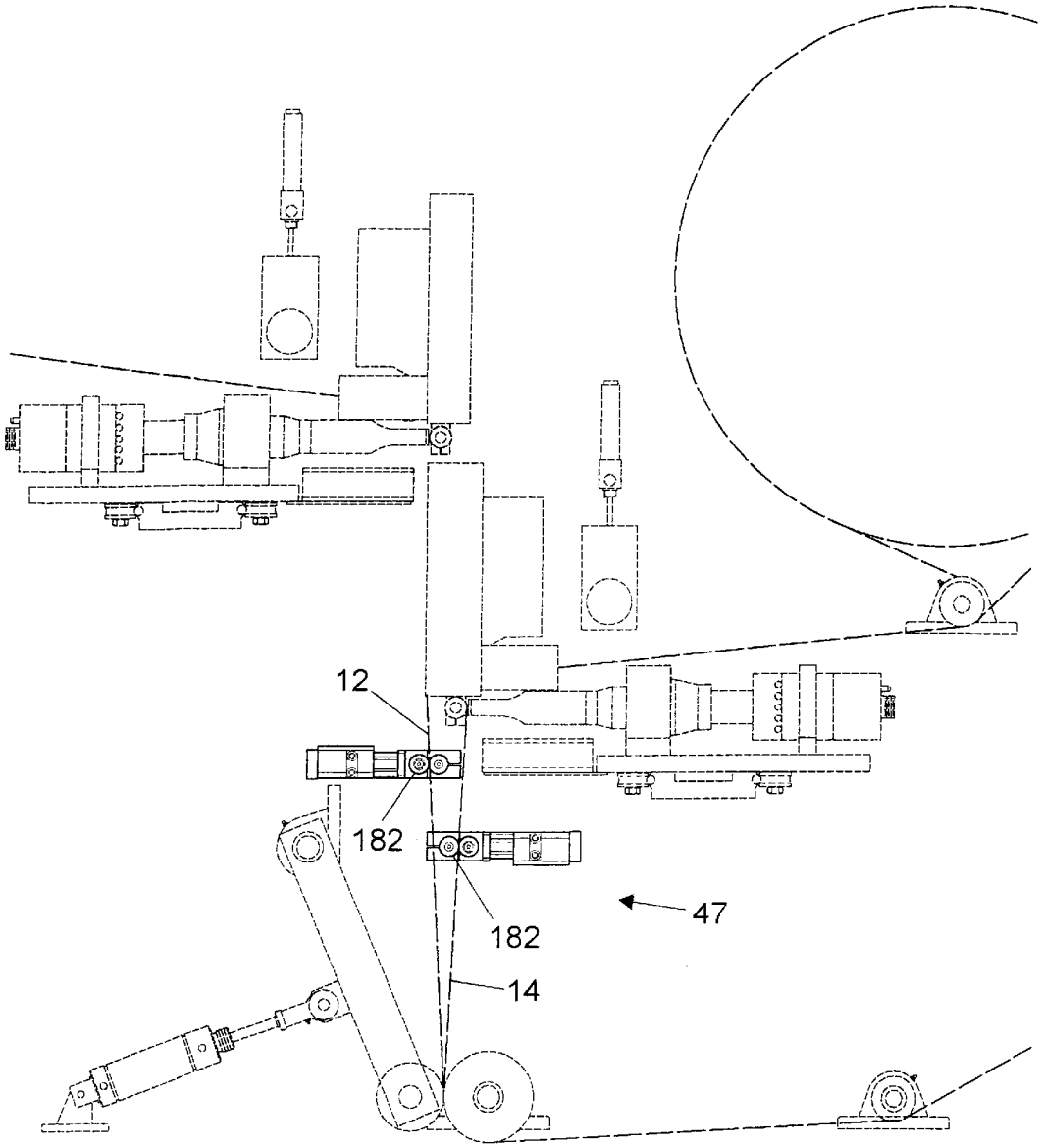
FIG. 16 is a schematic plan view of the apparatus with the first spreading assembly.

The welded structure is moved from the opened position to a closed position prior to being pulled through the nip rollers by the first shifter assembly 47 (see FIG. 16). The first shifter assembly 47 includes a first and second pair of angled bearings or rollers 182. The first pair of angled bearings shift the first sheet of sheer material in the cross-machine direction, while the second pair of angled bearings shift the second sheet of sheer material in the opposite cross-machine direction. In this manner the first and second sheets of sheer material 12, 14 are shifted relative to one another in the cross-machine direction. As a result, the center region 30 of the vane material 16 is substantially parallel to the first and second sheets of sheer materials 12 and 14. However, since the vane material 16 is welded to the first and second sheets of sheer material 12, 14 on the same side of the vane material 16, the first longitudinal margin 26 will be coplanar with the center region 30 of the vane material 16, while the second longitudinal margin 28 will be folded over and adjacent the center region 30 of the vane material 16. Of course if the first and second sheets of sheer material 12, 14 are shifted in the opposite direction, the first longitudinal margin 26 would be folded over and adjacent the center region 30, while the second longitudinal margin 28 would be substantially coplanar with the center region 30.

The nip rollers 180 are driven by the drive assembly 184 including a drive motor 186 and belt 188. A controller synchronizes the nip drive motor 186 and anvil drive motor 131 to coordinate the movement of the vane material 16 and sheer sheet materials 12, 14 through the apparatus.

Figure 17:
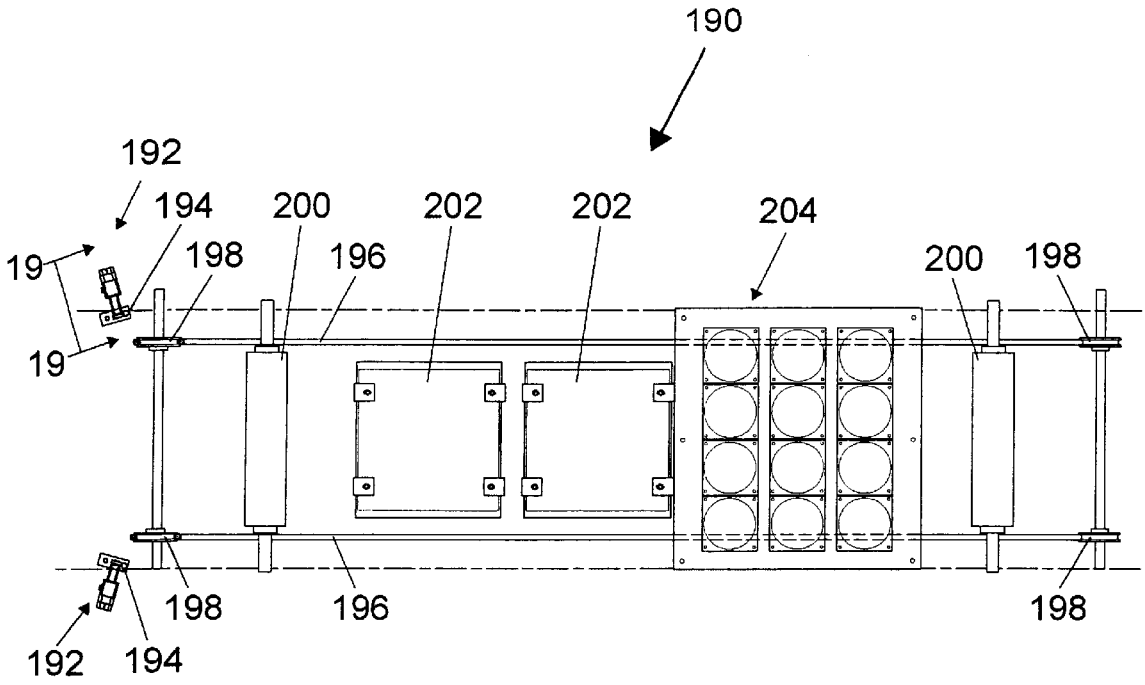
FIG. 17 is a top plan view of the apparatus with the tension assembly and heat setting assembly.
Figure 18:
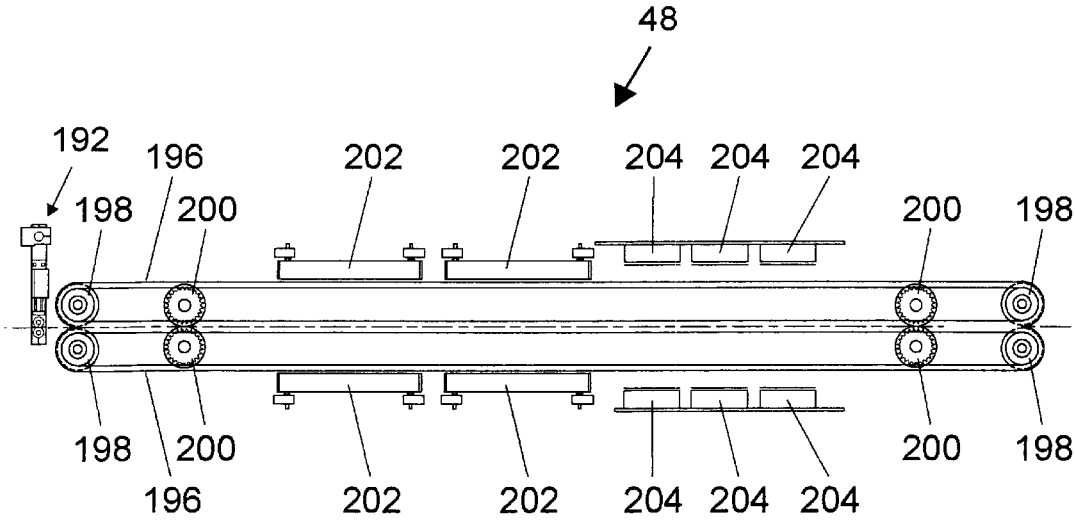
FIG. 18 is a side view of the apparatus of FIG. 17.
Figure 19:
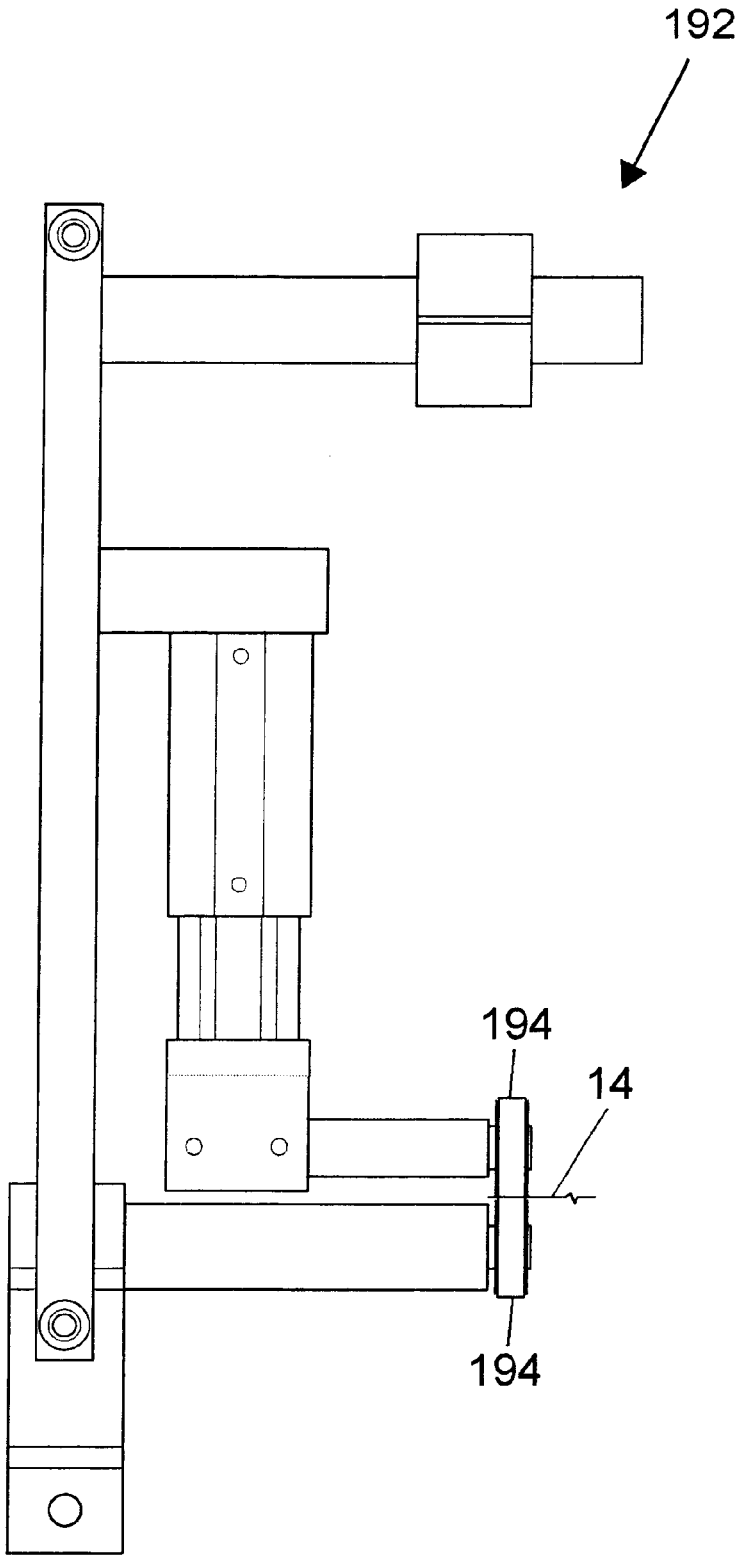
FIG. 19 is cross sectional view of the second shifter assembly of FIG. 17 taken generally along lines 19—19.

After the welded vane material 16 and sheer sheet materials 12, 14 are drawn through the nip rollers 180, a tentering apparatus 190 applies a tension to the resultant welded structure across the sheer sheet materials 12, 14 in both the cross-machine direction and the longitudinal direction. Referring to FIGS. 17–19, a second shifter apparatus 192 including a first and second pair of bearings or rollers 194 shifts the first and second sheets of sheer material respectively in the cross-machine direction. The second shifter apparatus 192 both ensures that the welded structure is in the closed position as well as applies a tension to the materials in the cross-machine direction. After the first and second sheets of sheer material have been shifted and tensioned in the cross-machine direction the welded structure is kept in tension in the cross-machine direction by a first and second pair of conveyors or o-rings 196 that are supported by pulleys 198. The o-rings are parallel to one another, but may also be angled to help maintain the tension of the materials in the cross-machine direction.

The first and second sheets of sheer material and the vane material is tensioned in the longitudinal direction by a first and second pair of nip rollers 200. Once the welded structure is tensioned it enters the heat setting assembly 48 to remove any unwanted creases in the welded structure. The welded structure is tensioned in the closed or light-blocking position with center region 30 and the first longitudinal margin 26 of the vane material 16 in a plane parallel to the first and second sheets of sheer materials 12 and 14. The second longitudinal margin 28 is not coplanar with the first longitudinal margin 26 and center region 30 of the vane material 16, but is bent at an edge 31, proximate the first sheet material 12.

In the preferred embodiment, a plurality of radiant heaters 202 that heat both the first and second sheets of sheer material as well as the vane material. The welded structure is then cooled with a plurality of fans 204. A mist of water could be applied to the welded structure prior to being exposed to the radiant heaters as a way of evenly distributing the heat. Alternatively, the welded structure could be pressed with a heated roller and then set by a cooled roller to prohibit the material from going back to its original condition.

Since no adhesive is used in this system, it is possible to heat the welded resultant product to a higher temperature without the concern of the adhesive remelting and flowing in an uncontrolled manner. As a result of the setting assembly all unwanted creases and or puckers are removed from the materials. The heat setting process forms a permanent crease 31 in the vane material at the second longitudinal margin 28.

Once the welded structure has been set, the structure is wound onto a take up spool for subsequent fabrication into the light-control window covering 10 based on a customer's specification. Alternatively, the structure may be cut into flat sheets of predetermined length for subsequent processing. As discussed above, the width of the welded structure determines the greatest possible length of the horizontal light-control window covering. First, based on the width dimension of the desired horizontal light-control window covering 10, that amount of material is cut from the take up spool in the longitudinal direction. Second, if the length of the desired horizontal light-control window covering 10 is less than the width of the welded structure, then the difference is removed from the width of the welded structure. In this manner a horizontal window covering 10 is formed to a customer's specification.

In preferred embodiment, the first sheet of sheer material 12 faces toward the room and away from the window, while the second sheet of sheer material 14 faces or is adjacent the window. As discussed above the width of the vane material is most preferably 2.062 inches, while the longitudinal margins 26, 28 of the vane material are about 0.125 inches. The folder assemblies are set 1.625 inches apart, and as a result the center regions 30 of adjacent vanes 16 are 1.625 inches apart in the light-passing position. In the light-blocking position, the vanes 16 overlap one another by 0.312 inches. In this manner, the folded second longitudinal margin 28 is hidden from view by the first longitudinal margin 26 and center region 30 of an adjacent vane.

It should be understood that the foregoing description is of a preferred exemplary embodiment of this invention, and that the invention is not limited to the specific form shown. For example, the vanes could also be welded to the first and second sheets of sheer material 12 and 14 in a s-shaped configuration. If the first longitudinal margin of the vane material is welded to the first sheet of sheer material 12 on its first face, while the second longitudinal margin of the vane material is welded to the second sheet of sheer material 14 on its second face, the vane would be s-shaped. This would require a redesign of the first folder to include an s-shaped channel.

Additionally, the equipment can be modified to dispense an adhesive to the vanes and or sheet materials instead of using welding stations. Similarly, the welding stations could be replaced with a sewing operation to stitch the vanes to the first and second sheets of sheer materials. It is also possible to weld one side of the vane to one of the first or second sheet of sheer material, and use adhesive or thread to attached to the other of the first and second sheet of sheer material. Any combination of welding, adhesive, and thread are possible and can be used to attach the vanes to the first and second sheets of sheer. material while processing the vane material and first and second sheets of sheer material with the method and apparatus described herein. Of course the welders would need to be replaced with appropriate adhesive dispensers and sewing equipment if an adhesive or thread is to be used for attachment of the vane material. Further, the u-shaped or s-shaped vane could include a crease proximate one of the longitudinal edges that is set in the heat setting station or the temperature and pressure could be set so as to not form a permanent crease in the vane material. The u-shaped vane in the final light-control window covering could either be upright such that the longitudinal edges face upward, or could be inverted such that the longitudinal edges face downward.

Additionally, the shifting of the material could be before or after the welded structure is threaded through the nip rollers. If the welded structure is pressed between the nip rollers before it the first and second sheer sheets have been shifted, a crease may form in the middle of the center region of the vane material. It may be possible to remove this crease in the heat setting station.

Further, the anvils used could include a single, double or triple stitch weld pattern, or could encompass a more fanciful pattern. While, the exemplary embodiment is for the fabrication of a horizontal light-control window covering, the welded product could also be formed into a vertical light-control window covering, in which the vanes would extend in a vertical orientation in a window opening. For a vertical light-control window covering, the width of the welded structure would be the greatest width of the vertical light-control window covering, while the length would be determined by the length of the welded structure on the take up spool. While the hardware for mounting the light-control window covering has not been discussed, one skilled in the art could use any of the various headrails and mechanisms available to raise and lower, or open and close, the light-control window covering, as well as to move the light-control window covering from a light-passing to a light-blocking position.

Further modifications may be made in the design, arrangement and combination of the elements without departing from the scope of the invention as expressed in the appended claims.

What is claimed is:

1. A light-control window covering comprising:

a first sheet of sheer material, and a second sheet of sheer material spaced apart from the first sheer sheet of material;

a plurality of vanes having a first face and a second face, a center region and a first and a second longitudinal margin, the first face of each vane being ultrasonically welded to the first and second sheets of sheer material along the respective first and second longitudinal margins, each vane having a single permanent crease;

the vanes being movable from a light-passing position in which the center region of each vane is substantially perpendicular to the first and second sheets of sheer material, to a light-blocking position in which the center region of each vane is substantially parallel to the first and second sheets of sheer material, the second longitudinal margin of each vane being folded over and adjacent the center region of each respective vane in the light-blocking position, and the vanes being spaced from one another such that in the light-blocking position the first longitudinal margin of one vane overlaps the second longitudinal margin of an adjacent vane.

2. The light-control window covering of claim 1, wherein the crease is between the center region and the second longitudinal margin.

3. The light-control window covering of claim 1, wherein each vane is u-shaped in the light-passing position.

4. The light-control window covering of claim 1, wherein the first longitudinal margin is substantially coplanar with the center region in the light-blocking position.

5. The light-control window covering of claim 1, wherein the second longitudinal margin is folded along the crease and adjacent the center region in the light-blocking position.

6. The light-control window covering of claim 1, wherein the first and second longitudinal margins face downward from the center region, to form an inverted u-shape.

7. A light-control window covering comprising:

a first sheet of sheer material, and a second sheet of sheer material spaced apart from the first sheer sheet of material;

a plurality of vanes having a first face and a second face, a center region and a first and a second longitudinal margin, the first face of each vane being operatively connected to the first and second sheets of sheer material along the respective first and second longitudinal margins, each vane having a single crease;

the vanes being movable from a light-passing position in which the center region of each vane is substantially perpendicular to the first and second sheets of sheer material, to a light-blocking position in which the center region of each vane is substantially parallel to the first and second sheets of sheer material, the second longitudinal margin of each vane being folded over and adjacent the center region of each respective vane in the light-blocking position, and the vanes being spaced from one another such that in the light-blocking position the first longitudinal margin of one vane overlaps the second longitudinal margin of an adjacent vane.

8. The light-control window covering of claim 7, wherein the crease is a permanent crease between the center region and the second longitudinal margin.

9. The light-control window covering of claim 8, wherein each vane is u-shaped in the light-passing position.

10. The light-control window covering of claim 9, wherein the first longitudinal margin is substantially coplanar with the center region in the light-blocking position.

11. The light-control window covering of claim 10, wherein the second longitudinal margin is folded along the crease and adjacent the center region in the light-blocking position.

12. The light-control window covering of claim 7, wherein the first and second longitudinal margins face downward from the center region, to form an inverted u-shape.

13. The light-control window covering of claim 7, wherein one of the first and second sheets of shear material comprises a knit sheer material.

14. The light-control window covering of claim 7, wherein the first and second sheets of sheer material comprise a knit sheer material.

15. The light-control window covering of claim 7, wherein the first and second sheets of sheer material include a plurality of interstices, and wherein the interstices of the first sheet of sheer material are of a different shape than the interstices of the second sheet of sheer material.

16. The light-control window covering of claim 7, wherein the first sheet of sheer material includes a plurality of diamond-shaped interstices.

17. The light-control window covering of claim 16, wherein the plurality of vanes comprises an opaque knit material.

18. The light-control window covering of claim 17, wherein at least one of the first and second sheets of sheer material are formed from a multi-filament yarn.

19. The light-control window covering of claim 7, comprising a repetitive stitching pattern formed along the first and second longitudinal margins of each vane.

20. The light-control window covering of claim 19, wherein the repetitive stitching pattern comprises a single stitch weld pattern.

21. The light-control window covering of claim 19, wherein the repetitive stitching pattern comprises a double stitch weld pattern.

22. The light-control window covering of claim 19, wherein the repetitive stitching pattern comprises a triple stitch weld pattern.

23. The light-control window covering of claim 7, wherein said crease is proximate at least one of the first longitudinal margin and second longitudinal margin.

24. The light-control window covering of claim 23, wherein each crease is a permanent crease.

25. The light-control window covering of claim 24, wherein each vane is u-shaped in the light-passing position.

26. The light-control window covering of claim 25, wherein the first longitudinal margin is substantially coplanar with the center region in the light-blocking position.

27. The light-control window covering of claim 26, wherein the second longitudinal margin is folded along the crease and adjacent the center region in the light-blocking position.

28. The light-control window covering of claim 27, wherein the first and second longitudinal margins face downward from the center region, to form an inverted u-shape.

* * * * *